US007126479B2

(12) United States Patent
Claessens et al.

(10) Patent No.: US 7,126,479 B2
(45) Date of Patent: Oct. 24, 2006

(54) METAL CONTAINER CLOSURE HAVING INTEGRAL RFID TAG

(75) Inventors: Francis M. Claessens, Barkham Square Park, Barkham, Berkshire (GB) RG40 4PN; Timo W. Kipp, 20 Ovington Square, London (GB) SW3 1LG; John P. Palmer, Palm Beach Gardens, FL (US)

(73) Assignees: Francis M. Claessens, Berkshire (GB); Timo W. Kipp, Palm Beach, FL (US)

( * ) Notice: Subject to any disclaimer, the term of this patent is extended or adjusted under 35 U.S.C. 154(b) by 99 days.

(21) Appl. No.: 10/920,094

(22) Filed: Aug. 17, 2004

(65) Prior Publication Data

US 2006/0038683 A1 Feb. 23, 2006

(51) Int. Cl.
*G08B 13/14* (2006.01)

(52) U.S. Cl. ..... 340/572.1; 340/572.8

(58) Field of Classification Search ..... 340/572.1, 340/572.5, 572.6, 572.8, 568.1, 10.33
See application file for complete search history.

(56) References Cited

U.S. PATENT DOCUMENTS

| | | | |
|---|---|---|---|
| 4,686,516 | A | 8/1987 | Humphrey |
| 4,711,368 | A | 12/1987 | Simons |
| 4,813,564 | A | 3/1989 | Cooper et al. |
| 4,825,801 | A | 5/1989 | Weber |
| 5,566,441 | A | 10/1996 | Marsh et al. |
| 5,602,530 | A | 2/1997 | Holmgren |
| 5,786,626 | A | 7/1998 | Brady et al. |
| 5,850,186 | A | 12/1998 | Min |
| 5,880,675 | A | 3/1999 | Trautner |
| 5,887,176 | A | 3/1999 | Griffith et al. |
| 5,953,682 | A | 9/1999 | McCarrick et al. |
| 6,031,457 | A | 2/2000 | Bonkowski et al. |
| 6,050,622 | A | 4/2000 | Gustafson |
| 6,069,955 | A | 5/2000 | Coppersmith et al. |
| 6,137,413 | A | 10/2000 | Ryan, Jr. |
| 6,162,550 | A | 12/2000 | Pinchen et al. |
| 6,215,402 | B1 | 4/2001 | Kodukula et al. |
| 6,226,619 | B1 | 5/2001 | Halperin et al. |
| 6,255,948 | B1 | 7/2001 | Wolpert et al. |

(Continued)

FOREIGN PATENT DOCUMENTS

| | | |
|---|---|---|
| EP | 0 619 243 B1 | 10/1994 |

(Continued)

OTHER PUBLICATIONS

Chang, K., entitled "RF and Microwave Wireless Systems," Section 3.9 "Microstrip Patch Antennas," Wiley Interscience ISBN 0-471-35199-7 (2000) pp. 90-98.

(Continued)

*Primary Examiner*—John Tweel, Jr.
(74) *Attorney, Agent, or Firm*—Amster, Rothstein & Ebenstein LLP

(57) ABSTRACT

An RFID tag system which communicates with a base station at a predetermined frequency for a container having a metal closure comprising an insulator mounted to an exterior surface of the metal closure and a radio transceiver system coupled to the insulator. The radio transceiver system further comprises an antenna tuned to the predetermined frequency mounted to an exterior surface of the metal closure and an RFID IC chip coupled to the antenna and coupled to the metal closure. In a first embodiment, the RFID IC chip is mounted outside the metal closure. In a second embodiment, the RFID IC chip is mounted within the metal closure and connected to the antenna outside the metal closure through an electrical feedthrough connection in the metal closure.

16 Claims, 3 Drawing Sheets

U.S. PATENT DOCUMENTS

| | | | |
|---|---|---|---|
| 6,271,753 | B1 | 8/2001 | Shukla |
| 6,329,915 | B1 | 12/2001 | Brady et al. |
| 6,483,473 | B1 | 11/2002 | King et al. |
| 6,501,435 | B1 | 12/2002 | King et al. |
| 6,549,131 | B1 | 4/2003 | Cote et al. |
| 6,556,139 | B1 | 4/2003 | Manov et al. |
| 6,641,052 | B1 | 11/2003 | Baillod et al. |
| 2001/0035815 | A1 | 11/2001 | Fletcher et al. |
| 2002/0031997 | A1 | 3/2002 | Lawler, Jr. et al. |
| 2002/0057201 | A1 | 5/2002 | Manov et al. |
| 2002/0067267 | A1 | 6/2002 | Kirkham |
| 2002/0175818 | A1 | 11/2002 | King et al. |
| 2003/0047530 | A1 | 3/2003 | Durbin |
| 2003/0222763 | A1 | 12/2003 | Pillai et al. |

FOREIGN PATENT DOCUMENTS

| | | | |
|---|---|---|---|
| EP | 1 083 519 | A2 | 3/2001 |
| FR | 2 703 659 | A1 | 10/1994 |
| JP | 2002181296 | A | 6/2002 |
| JP | 2002185358 | A | 6/2002 |
| WO | WO 00/02661 | | 1/2000 |
| WO | WO 00/54724 | | 9/2000 |
| WO | WO/ 01/51369 | A1 | 7/2001 |
| WO | WO 02/13135 | A2 | 2/2002 |
| WO | WO 02/095671 | A1 | 11/2002 |
| WO | WO 03/023705 | A1 | 3/2003 |
| WO | WO 03/023706 | | 3/2003 |

OTHER PUBLICATIONS

Denidni, T.A., entitled "Design of a Wideband Microstrip Antenna for Mobile Handset Applications," High Frequency Electronics (Feb. 2004) pp. 24-27.

Yoshimura, Y., entitled "A microstripline slot antenna," IEEE Transactions on Microwave Theory and Techniques, MTT-20, Nov. 1972, pp. 760-762.

Sobol, H., entitled "Applications of Integrated Circuit Technology to Mircrowave Frequncies," Proceedings of the IEEE, vol. 59, No. 8, Aug. 1971, pp. 1200-1211.

Rowley, J.T., et al., entitled "Performance of Shorted Microstrip Patch Antennas for Mobile Communications Handsets at 1800 MHz," IEEE Transactions of Antennas and Propagation, vol. 47, No. 5, 815-822 (May 1999) pp. 815-822.

Ali, M., et al., entitled "Wide-band/Dual-Band Packaged Antenna for 5-6 GHz WLAN Application," IEEE Transactions on Antennas and Propagation, vol. 52, No. 2, (Feb. 2004) pp. 610-615.

Chung, K. L., et al., entitled "A High Performance Circularly Polarized Stacked Patch Antenna with Low Mutual Coupling," Workshop on Applications of Radio Science, National Committee for Radio Science (Australia), Feb. 2004.

Whisky News—The Lastest Scotch Whisky Industry News, Jan. 2004 News at www.scotchwhisky.net/news/index.php, pp. 1-7.

Tomlinson, Heather, entitled "Spirits firms fight bottle-stamp plan," Guardian Unlimited, Dec. 11, 2003 at www.guardian.co.uk/budget2004/story/0.14063.1104532.00.html, pp. 1-2.

The Courier—entitlted "No evidence whisky fraud is widespread," Jan. 16, 2004 at www.thecourier.co.uk/output/2004/01/16/newsstory553366310.asp.

Andy's Scribbings Wine & Drink Newsletter—Issue 165, Jan. 22, 2004 at www.andys-scribbings.co.uk/oldScribbings/As165.htm, p. 2 of 3.

Sunday Herald—entitled "Why Chancellor's charm is beginning to wear thin," Dec. 14, 2003 at www.sundayherald.com/print38613, pp. 1-2.

HARPERS—entitled "Trade searches for 'tax stamps' alternative," Jan. 9, 2004, p. 5.

METAL CONTAINER CLOSURE HAVING INTEGRAL RFID TAG

FIELD OF THE INVENTION

The present invention relates to an apparatus and method for providing an RFID tag on a metal closure for a container such as a metal bottle cap.

BACKGROUND OF THE INVENTION

Mounting an RFID tag within a plastic cap for a container, e.g., a beverage bottle, has presented no difficulty since the plastic material does not significantly affect the transmission of the electromagnetic signal transmitted to the RFID tag.

However, the use of an RFID tag with a metal container closure or cap present certain design difficulties. As used herein, metal cap is understood to mean any metal closure for any type of container. Furthermore, references herein to bottles and metal caps for bottles is not to be understood as limiting the scope of the invention but merely illustrative of a particular application for the invention. At the high RF frequencies used for communication with an RFID tag, some transmitted signal energy will diffract and reflect into a metal cap from the open end of the metal cap so long as the fluid contents within the container remain below the bottom of the cap. However, a full container will likely prevent the RF signal from reaching an RFID tag mounted within a metal cap. Furthermore, since an RFID tag normally does not include an integral battery and is powered by the received RF energy, sufficient RF energy has to reach the RFID tag to power the integrated circuit chip on the RFID tag. It is unlikely that this would occur for an RFID tag mounted within a metal cap absent special circumstances, such as positioning the interrogator antenna at a very close range and at a specific orientation to the metal cap. Consequently, a conventional RFID tag mounted completely inside a metal cap does not appear to be practical.

Microstrip antenna technology originated in microwave transmission lines etched into radio frequency integrated circuits and into copper-clad printed circuit boards. A microstrip transmission line is a metal conductor path (usually etched copper) separated from an expansive conducting surface (ground plane) by an insulating dielectric layer. The width of the transmission line and the thickness of the dielectric medium determine the characteristic impedance of the transmission line, and thereby the efficiency of RF power transmission from one device to another. If the length of the microstrip transmission line is adjusted to be one-half the wavelength of RF waves in the dielectric layer, and if one or both ends of the transmission line are not connected to a device, then that transmission line radiates energy (or receives it) as an antenna. Consequently, the same technology and the same process steps can be used to produce an antenna and the necessary impedance matching components, resulting in lower manufacturing costs.

For these reasons, microstrip antennas are commonly used in connection with the interrogator of a RFID system. These antennas have the desirable characteristic of laying flat on a surface with minimum protrusion from that surface. However, they are not commonly used on RFID tags, primarily for the following three reasons: 1) The characteristic length of a simple microstrip antenna is one-half of the wavelength, whereas it is one-quarter of the wavelength for an electric dipole antenna. Consequently, for a given frequency of operation, the microstrip antenna must be twice the length the electric dipole antenna. 2) The simplest microstrip antennas have a narrower bandwidth than the electric dipole antenna, resulting in tighter manufacturing tolerances for the microstrip antenna. 3) Since the patch of the microstrip antenna is more massive than the wire antenna, the RFID tag IC chip must have more substantial power conversion and switching devices than is necessary for the wire antenna in order to modulate the backscattered RF energy return to the interrogator.

The use of a microstrip antenna for an RFID tag has been disclosed in U.S. Pat. No. 6,215,402, which includes several designs for patch antennas and impedance matching components for an RFID tag, and U.S. Pat. No. 6,329,915, which describes the use of an additional insulating material with high electric permittivity that is applied to the surface on top of the microstrip antenna in order to further reduce the size of the antenna. However, neither of these patents discloses the use of an RFID tag having a microstrip antenna on a metal closure for a container.

The use of specially designed slots etched into the interior of a patch antenna to broaden the bandwidth of a microstrip antenna without changing the overall form factor of the antenna is disclosed in an article by Ali, Sittironnarit, Hwang, Sadler, and Hayes, entitled "Wideband/Dual-Band Packaged Antenna for 5–6 GHz WLAN Application," that appeared in the February, 2004 issue of the journal IEEE Transactions on Antennas and Propagation. However, this article does not disclose the use of an RFID tag having a microstrip antenna on a metal bottle cap.

Accordingly, it is an object of the present invention to provide an RFID tag employing an antenna that can be mounted on the exterior of a metal closure for a container and that provides the same functionality as a conventional RFID tag mounted on a plastic closure for a container.

It is a further object of the present invention to provide an RFID tag for mounting on a metal cap that is not subject to close tolerances in manufacturing.

SUMMARY OF THE INVENTION

The present invention is directed to an RFID tag system which communicates with a base station at a predetermined frequency for use with a container having a metal closure. The RFID tag system includes an antenna and insulator adapted to be mounted to an exterior surface of the metal closure and an RFID chip coupled to said antenna and adapted to be coupled to the metal closure. In a first embodiment, the RFID chip is mounted outside the metal closure. In a second embodiment, the RFID chip is mounted within the metal closure and connected to the antenna outside the metal closure through an electrical feedthrough connection in the metal closure.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
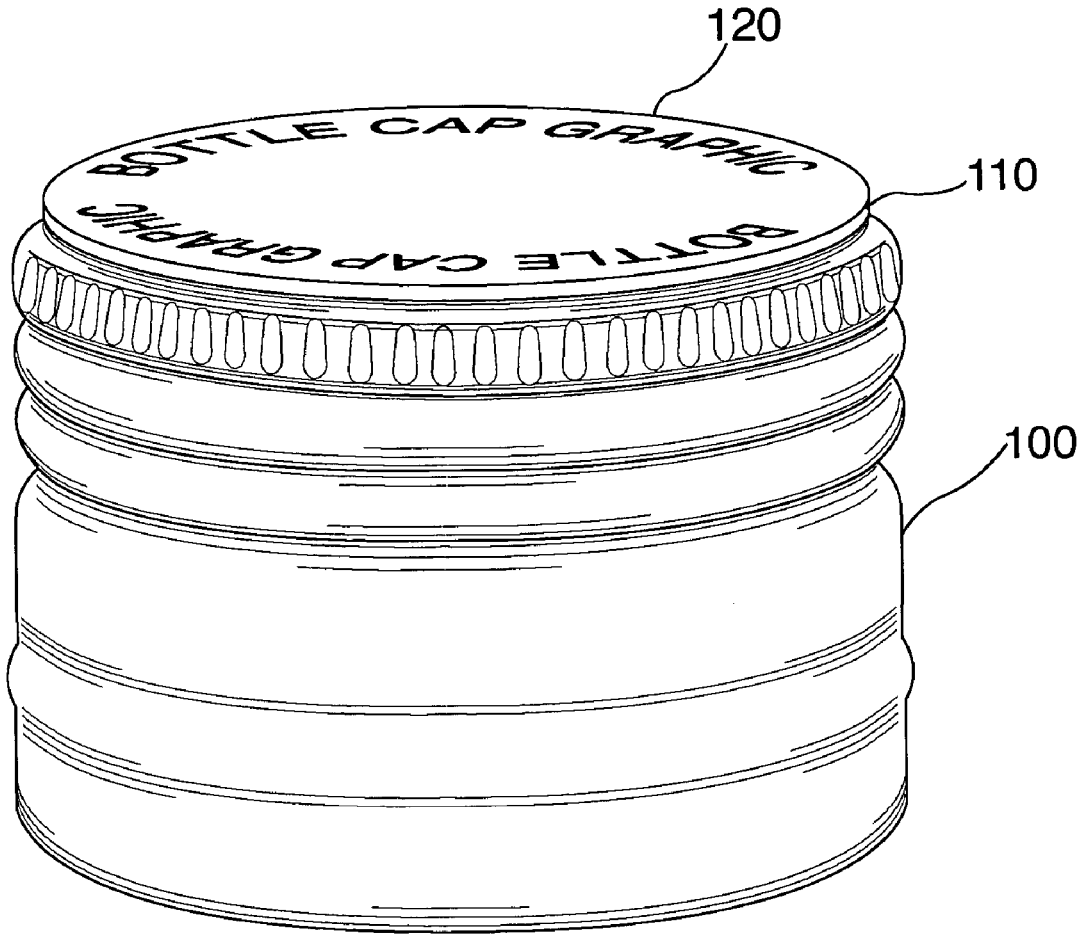
FIG. 1 is a perspective view of a metal bottle cap including an RFID tag mounted on a top thereof according to one aspect of the present invention.

Referring now to the drawing, and in particular to FIG. 1 thereof, therein illustrated is a metal cap 100 having a RFID tag 110 preferably employing a microstrip patch antenna (not shown) where the RFID tag 110 is bonded to the top of metal cap 100. The top surface 120 of RFID tag 110 can thereafter be decoratively printed in the same manner as conventional metal caps.

As discussed above, the IC chip of RFID tag 110 may be located either outside the metal cap or inside the cap. Locating the chip outside the cap results in lower manufacturing costs since no feed-through connections are required. However, there may be functional incentives to locate the chip inside the cap, in which case one or more electrical feed-through connections are required to conduct signals from the antennal patch to the IC chip.

The microstrip patch antenna is naturally adapted to metal caps because the metal cap serves as the ground-plane for the antenna. The complementary metal surface (i.e., the patch) of the microstrip antenna is positioned on top of the metal cap with an insulating spacer between the two metal surfaces.

Two radio frequency bands are allocated by the Federal Communications Commission for RFID systems, 2.4 GHz and 5.8 GHz. Both of these frequency bands are used for other applications, including wireless telephones and wireless local area networks.

The characteristic dimension of the antenna that causes it to be tuned to a specific frequency (and the harmonics of that frequency) is larger for the simple patch antenna (one-half wavelength) than it is for a one-quarter wavelength electric dipole antenna, although more complex patch antennas can be fabricated that are the same characteristic length. Consequently, the simplest (and least costly) of 2.45 GHz patch antennas would barely fit on top of the smallest standard metal cap (1⅛ inch diameter). There are other design options that could make it possible, from a technical standpoint, to use 2.45 GHz, although at a higher manufacturing cost. Alternatively, the 5.8 GHz microstrip antenna has a characteristic dimension of less than 1 inch and thus fits more easily on the top of conventional metal bottle caps.

When using a microstrip patch antenna, the RFID IC chip may be located either outside of the metal cap or within the metal cap. Locating the IC chip on the outside surface results in lower manufacturing cost, since feed-throughs are required to connect the antenna to the IC chip when the IC chip is mounted within the metal cap. Although a single feed-through could be used to connect the antenna to the IC chip, thereby reducing manufacturing costs, when two feed-throughs are employed, the length of the antenna patch can be reduced by 50%.

The microstrip antenna is preferred for a metal cap because, when properly designed, (1) it is more efficient receiving and re-radiating the resonant RF energy, (2) it offers a low profile on the bottle cap and (3) there is sufficient space on the top of the bottle cap to place the antenna if the system is operated at 2.45 GHz or at 5.8 GHz. Furthermore, the higher frequency 5.8 GHz microstrip antenna allows more design freedom and could lead to a lower-cost metal cap with integral RFID tag.

The characteristic length of the antenna patch, and the dielectric permittivity of the insulating layer, determine the frequencies at which the antenna may be used. Consequently, the diameter of the metal cap is the main consideration in selecting one of the two frequency bands that have been allocated by the Federal Communications Commission in the U.S. for use in RFID systems. The 2.45 GHz frequency band is widely used for RFID applications, while only a few systems have been developed for RFID at the higher 5.8 GHz frequency band. However, relevant radio technology at 5.8 GHz has been developed extensively for other applications such as cordless telephones and wireless local area networks.

Figure 2:
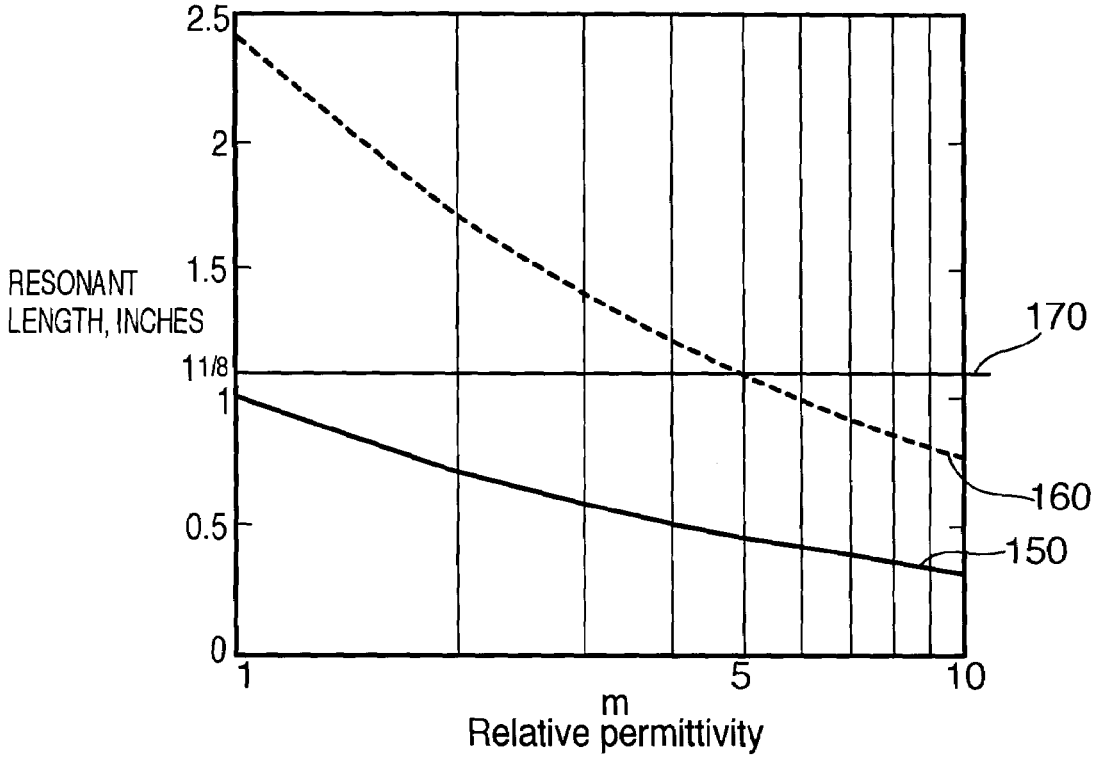
FIG. 2 is a plot of the length of a microstrip antenna versus the dielectric permittivity of the corresponding insulating layer that is used to calculate the size of the microstrip antenna for different applications according to another aspect of the present invention.

The characteristic length of the antenna patch is plotted as a function of the dielectric permittivity of the insulating layer at frequencies of 2.45 GHz (plot 160) and 5.8 GHz (plot 150) in FIG. 2. The thickness of the dielectric layer also has an effect on the characteristic length, at a given frequency, but the effect is much less than the permittivity. As seen from the plots, in order for the antenna patch to fit on the smallest standard size metal cap in the U.S. (i.e. a diameter of 1⅛ inch shown as line 170 in FIG. 2), the dielectric permittivity of the insulator for a 2.45 GHz antenna must be 5 or greater since only that portion of plot 160 lies beneath line 170. However, since plot 150 lies entirely beneath line 170, the patch will fit on the cap with any dielectric material for the 5.8 GHz antenna.

A table of the dielectric permittivity for various low-loss insulating materials manufactured by the Rogers Corp. is shown in Table I.

TABLE I

| Product (Rogers) | Composition | Relative dielectric constant |
|---|---|---|
| RT/duroid 5880 | PTFE glass fiber | 2.2 |
| RT/duroid 5870 | PTFE glass fiber | 2.33 |
| ULTRALAM 2000 | PTFE woven glass | 2.5 |
| RT/duroid 6002 | PTFE ceramic | 2.94 |
| RO3003 | PTFE ceramic | 3 |
| RO3203 | PTFE ceramic reinforced woven glass | 3.02 |
| TMM 3 | Hydrocarbon ceramic | 3.27 |
| RO4003C | Hydrocarbon ceramic | 3.38 |
| RO4350B | Hydrocarbon ceramic | 3.48 |
| RO4450B | Hydrocarbon ceramic prepreg | 3.54 |
| TMM 4 | Hydrocarbon ceramic | 4.5 |
| TMM 6 | Hydrocarbon ceramic | 6 |
| RT/duroid 6006 | PTFE ceramic | 6.15 |
| RO3006 | PTFE ceramic | 6.15 |
| TMM 10 | Hydrocarbon ceramic | 9.2 |
| TMM 10i | Hydrocarbon ceramic | 9.8 |
| RT/duroid 6010LM | PTFE ceramic | 10.2 |
| RO3010 | PTFE ceramic | 10.2 |
| RO3210 | PTFE ceramic reinforced woven glass | 10.2 |

The data from FIG. 2 and Table 1 demonstrates that several dielectric materials are available for a 2.45 GHz RFID microstrip antenna, e.g., TMM6 and RO3210. However, it is important to note that the antenna efficiency and therefore the sensitivity and range of the RFID tag, diminishes at higher values of permittivity (e.g., TMM6 is preferable over RO3210). This increases the need for precise impedance matching when employing an RFID tag operating at 2.45 GHz.

First Embodiment

Figure 3:
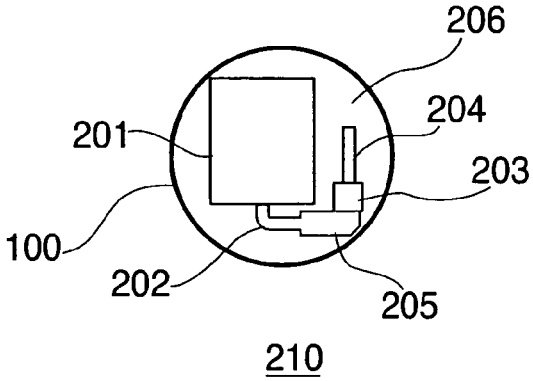
FIG. 3 is circuit diagram of a first embodiment of the present invention.

FIG. 3 is a circuit diagram illustrating a first embodiment of the present invention which is based upon a 5.8 GHz frequency band design. The RFID tag 210 includes a fiberglass insulator 206 having a relative permittivity 2.5 that is bonded to the top of metal cap 100, an antenna 201 that is mounted upon fiberglass insulator 206, IC chip 203, microstrip impedance-matching elements 202 and 205 which are also are mounted upon fiberglass insulator 206 and which couple antenna 201 to IC chip 203, and microstrip ¼-wave transformer 204 that is also coupled to IC chip 203 and which couples RF signals to the ground plane (i.e., the metal forming cap 100) and eliminates the need for any direct electric connections between metal cap 100 and the RFID circuit mounted on insulator 206. This form of coupling is well known among those of skill in the art of RF design. The configuration of this embodiment provides the lowest RFID tag cost and is generally limited to applications communicating via a 5.8 GHz link, since for many applications there will be insufficient room on the top of the metal cap for a 2.45 GHz patch together with impedance matching elements and IC chip. Design details for the microstrip impedance matching elements 202 and 205 are known to those of skill in the art, see, e.g., K. Chang, *RF and Microwave Wireless Systems*, Section 3.9 "Microstrip Patch Antennas", Wiley Interscience ISBN 0-471-35199-7 (2000) which is incorporated herein by reference. The number of quarter wavelength sections required, and their specific dimensions, are selected on the basis of the width of the patch, the thickness of the dielectric, and the permittivity of the dielectric.

Second Embodiment

Figure 4:
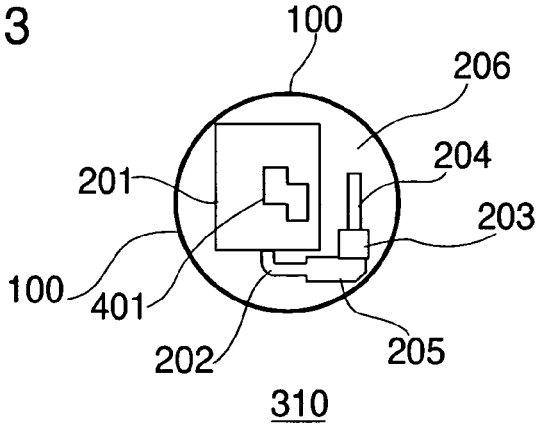
FIG. 4 is a circuit diagram of a second embodiment of the present invention.

Since the simplest patch atennas have only a 2% to 5% bandwidth, it may be desirable in terms of manufacturability to increase the bandwidth of a microstrip patch antenna to ensure that RFID tags are not tuned away from the frequency of the associated interrogator due to variations in component tolerances that arise in the manufacturing process. As one of skill in the art will readily recognize, an RFID tag having an increased bandwidth will still be able to communicate with an associated interrogator, even if the center frequency of the RFID tag varies from its intended value because of manufacturing tolerances, the influence of nearby dielectric materials or other factors. One method to increase the bandwidth of a patch antenna is disclosed in U.S. Patent Publication No. 2003/0222763, incorporated herein by reference. In that publication, a method is disclosed that increases the bandwidth of a patch antenna by 14% or more by etching slots in the patch antenna. An example, based on the methods disclosed in this publication is shown in FIG. 4 for an RFID tag system 310 that uses a 5.8 GHz patch antenna.

In particular, the RFID tag system 310 includes the same components as the RFID tag system 210 of FIG. 3 and discussed above. The only change is the addition of a slot 401 in patch antenna 201. Slot 401 in antenna 201 is asymmetrically shaped, and it is located off-center on the patch antenna 201 which provides patch antenna 201 with the effect of being two antennas that are closely spaced in frequency, thereby increasing the bandwidth thereof.

Third Embodiment

In some applications, it may be necessary to position the REID IC chip inside the metal cap. For example, it may be necessary to employ the RFID tags of the present invention in a larger system having interrogators that operate at a 2.8 GHz transmission frequency. In that case, since, as discussed above, the antenna patch could take up most of the area on the top of a metal cap, only the antenna patch could be positioned outside the metal cap and the antenna connected to the RFID chip is mounted inside the cap and connected to the external antenna via a feed-through connection, i.e., a wire connection that passes through the metal cap.

Figure 5A:
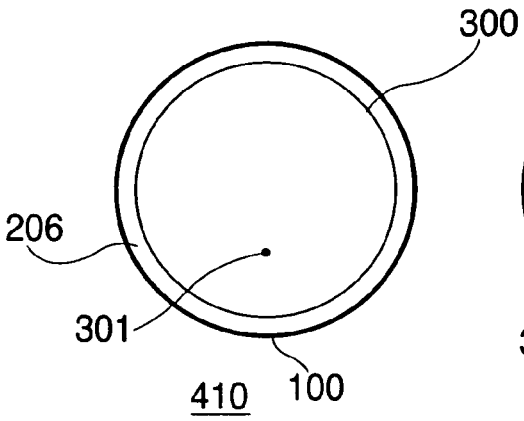
FIGS. 5A and 5B are circuit diagrams of a third embodiment of the present invention.
Figure 5B:
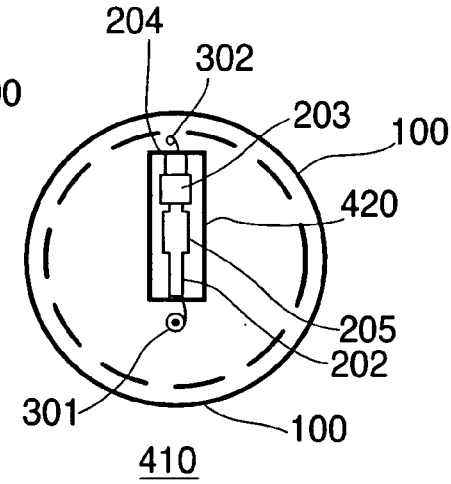

FIGS. 5A and 5B disclose an RFID tag system 410 that operates at 2.8 GHz. FIG. 5A is a top view of cap 100 and shows an insulator 206 mounted on top of cap 100, and circular antenna 300 mounted on top of insulator 206. Preferably, insulator 206 is formed from Duroid 6006 (or comparable) dielectric material. Antenna 300 is connected to the components located within cap 100 via feedpoint 301. As one of skill in the art will readily recognize, the location of feedpoint 301 may be adjusted to optimize the impedance matching to the transmission line 202 (FIG. 5B) on the inside of cap 100. FIG. 5B shows a bottom view of cap 100, showing feedpoint 301 connecting to transmission line 202, which, in turn, is connected to transmission line 205. As in the previous embodiments, transmission line 205 is thereafter connected to RFID IC chip 203. As one of skill in the art will readily recognize, the transmission lines 202 and 205 are used to optimize the coupling of patch antenna 300 to IC chip 203. IC chip 203 is connected to transmission line 204 for coupling to the ground plane formed by metal cap 100 via connection 302. IC chip 203 and transmission line components 202, 204 and 205 are attached to a thin substrate 420. The physical connections between the transmissions lines 202 and 204 and connections 301 and 302, respectively, may be wire bonds, as shown, or alternatively, substrate 420 may be connected in other ways, e.g., sweat soldered or ultrasonically bonded to the connections 301 and 302, as understood by one of skill in the art.

If the bandwidth of the system illustrated in FIGS. 5A and 5B proves to be too narrow due to manufacturing tolerance problems, etc., a band widening slot can be etched in antenna 300 in a manner similar to that described with respect to the second embodiment of the present invention shown in FIG. 4.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not be the foregoing specification.

We claim:

1. An RFID tag system which communicates with a base station at a predetermined frequency for a container having a metal closure comprising:

an insulator adapted to be mounted to a metal surface of said metal closure; and a radio transceiver system mounted on said insulator comprising an antenna tuned to said predetermined frequency; and an RFID IC chip electrically coupled to said antenna and electrically coupled to said metal closure.

2. An RFID tag system for communication with a base station at a predetermined frequency comprising:

a metal bottle cap having an interior surface, an exterior surface, and an electrical feedthrough connection from said interior surface to said exterior surface;

an insulator mounted to an exterior surface of said metal bottle cap;

a patch antenna mounted to said insulator and coupled to said electrical feedthrough connection at an exterior point, said patch antenna tuned to said predetermined frequency; and an RFID IC chip mounted on an interior surface of said metal bottle cap and coupled to said patch antenna via said feedthrough connection and to said metal bottle cap.

3. The RFID tag system of claim 1, further comprising microstrip impedance-matching elements which couple said antenna to said RFID IC chip.

4. The RFID tag system of claim 1, further comprising a microstrip quarter-wave transformer connected to said RFID IC chip for electrically coupling said RFID IC chip to said metal closure.

5. The RFID tag system of claim 1, in which said predetermined frequency is 5.8 GHz and said insulator has a relative permittivity of about 2.5.

6. The RFID tag system of claim 2, further comprising microstrip impedance-matching elements which couple said RFID IC chip to said electrical feedthrough connection.

7. The RFID tag system of claim 2, further comprising a microstrip quarter-wave transformer connected to said RFID IC chip for coupling said RFID IC chip to said metal bottle cap.

8. The RFID tag system of claim 2, in which said predetermined frequency is 2.45 GHz and said insulator has a relative permittivity of about 6.15.

9. An RFID tag system which communicates with a base station at a predetermined frequency for a container having a metal closure comprising:

an insulator adapted to be mounted to a metal surface of said metal closure; and a radio transceiver system-mounted on said insulator comprising antenna tuned to said predetermined frequency, said antenna including an asymmetrical slot positioned off-center therein; and an RFID IC chip electrically coupled to said antenna and electrically coupled to said metal closure.

10. The RFID tag system of claim 9, further comprising microstrip impedance-matching elements which couple said antenna to said RFID IC chip.

11. The RFID tag system of claim 9, further comprising a microstrip quarter-wave transformer connected to said RFID IC chip for electrically coupling said RFID IC chip to said metal closure.

12. The RFID tag system of claim 9, in which said predetermined frequency is 5.8 GHz and said insulator has a relative permittivity of about 2.5.

13. An RFID tag system for communication with a base station at a predetermined frequency comprising:

a metal bottle cap having an interior surface, an exterior surface, and an electrical feedthrough connection from said interior surface to said exterior surface;

an insulator mounted on an exterior surface of said metal bottle cap;

a patch antenna mounted on said insulator and electrically coupled to said electrical feedthrough connection, said patch antenna tuned to said predetermined frequency; and an RFID IC chip mounted on an interior surface of said metal bottle cap and electrically coupled to said patch antenna via said feedthrough connection and electrically coupled to said metal bottle cap.

14. The RFID tag system of claim 13, further comprising microstrip impedance-matching elements which couple said RFID IC chip to said electrical feedthrough connection.

15. The RFID tag system of claim 13, further comprising a microstrip quarter-wave transformer connected to said RFID IC chip for electrically coupling said RFID IC chip to said metal bottle cap.

16. The RFID tag system of claim 13, in which said predetermined frequency is 2.45 GHz and said insulator has a relative permittivity of about 6.15.

* * * * *